United States Patent [19]

Lampe et al.

[11] 4,236,920

[45] Dec. 2, 1980

[54] STEEL ALLOY

[75] Inventors: Väino Lampe; Staffan H. Gunnarsson; Karl-Erik Johansson, all of Hagfors, Sweden

[73] Assignee: Uddeholms Aktiebolag, Hagfors, Sweden

[21] Appl. No.: 29,104

[22] Filed: Apr. 11, 1979

[30] Foreign Application Priority Data

May 2, 1978 [SE] Sweden ..... 7804997

[51] Int. Cl.[3] ..... C22C 39/20

[52] U.S. Cl. ..... 75/128 A; 74/128 C; 75/128 W; 75/128 V

[58] Field of Search ..... 75/128 C, 128 A, 128 W, 75/128 V, 128; 148/38

[56] References Cited

U.S. PATENT DOCUMENTS

| | | | |
|---|---|---|---|
| 3,086,858 | 4/1963 | Edminster et al. | 75/128 V |
| 3,198,631 | 8/1965 | Jones | 75/128 D |
| 4,140,527 | 2/1979 | Kawai et al. | 75/128 V |

FOREIGN PATENT DOCUMENTS

| | | | |
|---|---|---|---|
| 337349 | 10/1930 | United Kingdom | 75/128 V |

*Primary Examiner*—M. J. Andrews
*Attorney, Agent, or Firm*—Murray and Whisenhunt

[57] ABSTRACT

A steel alloy is disclosed which is suitable for use in parts exposed to extreme stress and wear at high temperatures comprising the following chemical composition in percentage by weight:

| | | |
|---|---|---|
| C | | 1.5 |
| Si | appr | 0.7 |
| Mn | | 2.0 |
| Cr | | 21.5 |
| Ni | | 5.0 |
| Mo | | 0.6 |
| W | | 1.25 |
| V | | 2.25 |

balance iron.

A tube piercing mill roller and a tube mill rolling mandrel of said steel are also disclosed.

11 Claims, 6 Drawing Figures

STEEL ALLOY

The present invention refers to a steel alloy primarily intended for parts exposed to heavy stresses and wear by objects of high temperatures and then show good durability, very high resistance to wear and very inconsiderable propensity to grating. The invention in particular refers to a steel alloy being specially suitable for such products as e.g. roller entry guides for tube piercing mills and rolling mandrels in tube mills. Other products which it should be possible to manufacture from this alloy according to the invention are such hot work tools as are exposed to heavy wear and great temperature variations as for instance die forging tools, wear plates for anvils, matrices for hot extrusion of metals, etc.

For e.g. roller entry guides for tube piercing mills have so far to a very great extent been used chromium-nickel steels alloyed with molybdenum and cobalt. The performance characteristics of this material are, however, clearly unsatisfactory, above all due to the durability being too low.

A first object of the invention is therefore to offer a steel alloy having a modified composition with better properties as to roller entry guides, rolling mandrels for tube mills and similar tools.

A second object of the invention is to offer an alloy to be used in cast state for roller entry guides, rolling mandrels and similar products.

A third object is to offer an alloy which is in its cast state resistant to thermal shocks, i.e. has great resistance to abrupt temperature changes.

A fourth object is to offer a material having very high resistance to wear, i.e. high heat resistance.

A fifth object is to offer a material having very low propensity to tearing, i.e. propensity to tear such objects, e.g. a tube, as are in their hot state being worked by the material in question.

A sixth object is to offer a material having a not too complicated composition in order to make scrap recirculation easier.

A seventh object is to offer a material having a relatively cheap composition.

The reason for the low durability of the material used so far is above all that it is crack sensitive at temperature variations, bringing about substantial de-scaling of material when using the tool. The crack sensitivity in turn essentially depends on a high content of martensite or, more correctly, on the phase conversions taking place in a "martensitic" material at thermocycling and in turn brings about substantial strains giving rise to the cracks in question. Another object of the invention is therefore to offer a steel alloy the matrix of which principally consists of a stable austenitic phase and containing max. 20 percent martensite by volume.

To attain very high resistance to wear a further object is to offer a steel containing large carbides, more definitely a steel which in a cast state contains large lattices of more or less continuous aggregates of chromium carbides. More definitely there is an object of achieving a steel containing between 10 and 40 percent chromium carbides by volume, preferably between 15 and 35 percent chromium carbides by volume.

Another object is to offer a steel having very low propensity to grating by effecting such high hardness in the steel matrix, i.e. in the austenitic fields between the chromium carbides, that they will not essentially come out in relief in the material as the tool is subjected to wearing. More definitely an object is then to bring about a separation of a finely dispersed carbide phase in the essentially austenitic matrix of the steel.

Another object is to offer a material which can be used in a cast condition without heat treatment prior to use.

Yet another object is to offer a material which can above all be forged.

These and other objects can be fulfilled by the invention being characterized by what is indicated in the following claims.

In the following description an account is made of the results obtained using different steel alloys, reference being made to the enclosed drawings, in which FIG. 1 shows a longitudinal section of a roller entry guide with damages typical to this kind of tool.

Figure 1:
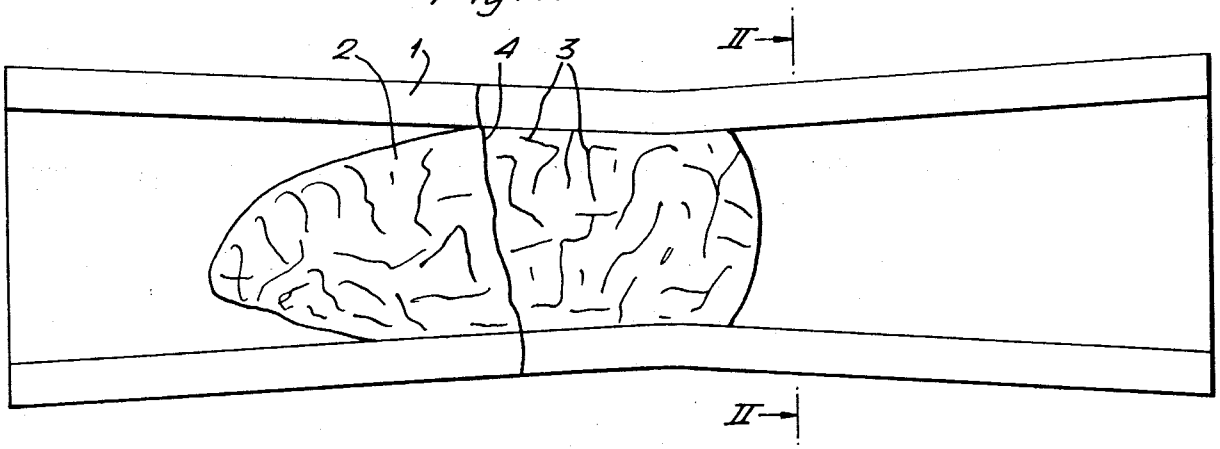
Figure 2:
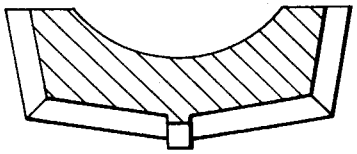
FIG. 2 is a section of II—II of FIG. 1.

In FIGS. 1 and 2 a roller entry guide is generally shown as 1. The roller entry guide consists of a groove tapering towards the centre and widening towards the ends and exhibiting a cup-shaped section. Tools of this kind are used when piercing tube blanks—billets—in a Mannesmann piercing mill, as it is called. The tube blank is then brought between two roller entry guides turned one towards the other and two rollers arranged between the guides, at the same time as the blank is pierced by means of a mandrel. Very heavy stresses then arise in the contact area 2 between guides and blank. With tools made of materials known so far this has resulted in considerable crack formation in the surface due to thermal shocks in the cyclical treatment and a heavy wear. Tool breaks 4 are also of frequent occurrence.

Figure 3:
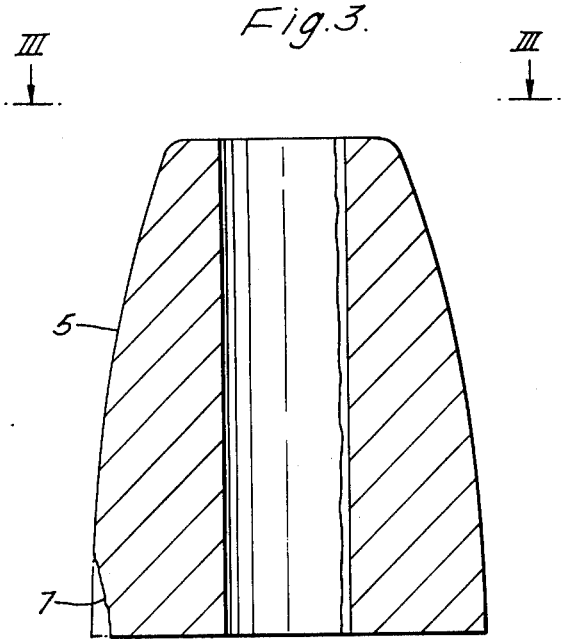
FIG. 3 is a longitudinal section of a rolling mandrel for tube mills.
Figure 4:
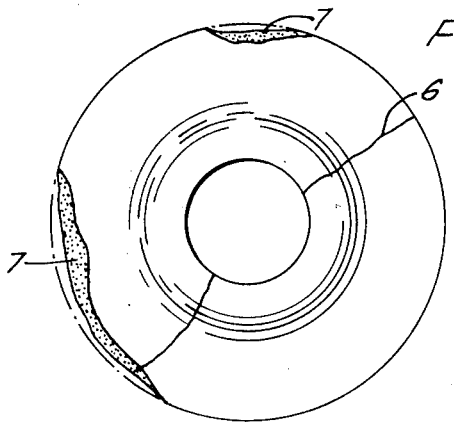
FIG. 4 is a view IV—IV of FIG. 2.

Similar attacks occur on mandrels of the kind used in tube rolling. In FIGS. 3 and 4 such a mandrel is designated 5. Thus there are both tangential and radial cracks 6 from working area to centre. There is also a general tendency to heavy stresses in the rear part 7 which in the case of materials used so far is often in a regrettably bad state already after being used for a short time. Typical damages have in FIGS. 3 and 4 been indicated by 7.

In conjunction with the devlopment of the steel according to the present invention a series of different steel types were tested. Their nominal compositions were as follows.

TABLE 1

Nominal compositions. Percentage by weight, balance iron.

| Steel type | C | Si | Mn | Cr | Ni | Mo | W | Co | V | N |
|---|---|---|---|---|---|---|---|---|---|---|
| L | 0.9 | 0.5 | 0.5 | 17.0 | 3.5 | 0.5 | — | — | | |
| P | 1.9 | 0.6 | 0.3 | 20.0 | 1.5 | — | 2 | 2 | 0.1 | |
| P2 | 1.0 | 0.5 | 0.5 | 21.5 | 5.0 | 0.6 | 1.25 | 0.5 | 0.25 | |
| P21 | 1.0 | 0.5 | 2.0 | 21.5 | 5.0 | 1.6 | 1.25 | — | 0.25 | |
| C | 1.0 | 0.9 | 12.5 | 20.0 | — | 2.5 | — | — | 1.6 | .05-.25 |
| E | 1.0 | 0.9 | 14.5 | 20.0 | — | 2.5 | — | — | 1.6 | — |
| D | 1.0 | 1.0 | 14.5 | 21.5 | 2.2 | 2.5 | — | — | 1.5 | |
| Z | 0.5 | 1.0 | 13.0 | 5.0 | — | 2.5 | — | — | 1.5 | |
| P3 | 1.5 | 0.7 | 2.0 | 21.5 | 5.0 | 0.6 | 1.25 | — | 2.25 | — |

P and S in normal contents of impurities.

Of every type of steel one or more charges have been produced having the following compositions expressed in percentage by weight, balance iron and impurities in normal contents.

TABLE 2

| Steel type | Steel No. | C | Si | Mn | Cr | Ni | Mo | W | Co | V | Cu | N |
|---|---|---|---|---|---|---|---|---|---|---|---|---|
| L | 1 | .91 | .31 | .38 | 17.5 | 3.7 | .64 | .18 | .13 | — | .15 | — |
| | 2 | 1.86 | .74 | .27 | 19.9 | 1.68 | .10 | 2.05 | 1.75 | 1.5 | .10 | .22 |
| P | 3 | 1.79 | .57 | .31 | 20.7 | 1.82 | .13 | 2.14 | 1.87 | .16 | .11 | — |
| | 4 | 1.75 | .58 | .28 | 19.6 | 1.74 | .10 | 2.03 | 1.75 | .14 | .12 | — |
| | 5 | .96 | .50 | .44 | 20.8 | 6.0 | .78 | 1.37 | — | .28 | .12 | — |
| P2 | | | | | | | | | | | | |
| | 6 | 1.01 | .49 | .26 | 21.6 | 5.0 | .78 | 1.25 | — | .28 | .17 | — |
| P21 | 7 | 1.11 | .57 | 2.26 | 21.9 | 5.4 | 1.67 | 1.34 | — | .27 | .12 | — |
| C | 8 | 1.03 | .89 | 12.7 | 20.1 | — | 2.5 | — | — | 1.60 | — | .22 |
| E | 9 | 1.00 | .89 | 14.7 | 19.7 | — | 2.5 | — | — | 1.58 | — | — |
| D | 10 | .98 | 1.05 | 14.3 | 21.4 | 2.19 | 2.4 | — | — | 1.52 | — | — |
| Z | 11 | .50 | .97 | 13.6 | 5.3 | — | 2.5 | — | — | 1.52 | — | — |
| | 12 | 1.44 | .69 | 2.3 | 21.8 | 5.1 | .61 | 1.37 | — | 2.5 | .10 | — |
| P3 | 13 | 1.43 | .69 | 2.5 | 21.7 | 5.1 | .57 | 1.25 | — | 2.4 | .09 | — |

Roller entry guides made of steel type L have for a long time been used in tube manufacture. They have lasted for roughly 4 hours and then normally broken. This life must be considered as short. However, the wear resistance is good and the resistance to grating low. In order to investigate if a modified heat treatment could increase the length of life, a number of guides were cast from steel No. 1. To increase the content of retained austenite in the material the guides were annealed at 1100° C., then left to cool in air. Field tests have shown a certain improvement, mainly due to increased tenacity in the material, i.e. the roller entry guides did not break to the same extent as before. A metallographic examination of the tested guides showed, however, that the austenite that had formed in the heat treatment had not been stable but been converted into martensite. As this is something that should be avoided in order to reduce the formation of thermal cracks, it is evident that a modified heat treatment for this material is not enough to improve its strength permanently. The resistance to wear should be somewhat increased and the resistance to grating further reduced.

Of type P steel rolling mandrels have earlier been used to a great extent. Steels 2–4 are representative of this type. However, its strength has been quite unsatisfactory due to cracks of the kind shown in FIGS. 3–4 appearing very soon. For roller entry guides with their still heavier stresses this material is quite unthinkable due to the apparent risk of early ruptures.

Type P2 was developed in order to get a steel essentially based on type L but having better high-temperature strength and resistance to wear. As compared with type L the carbon and chromium contents were increased in order to get a larger number of carbides. The nickel content was increased to stabilize the austenite. Tungsten and vanadium were added in order to get a finely dispersed secondary carbide precipitation. Fifteen guides were made of this alloy and successfully tested under operating conditions. The strength was found to be good and so was the resistance to wear, at the same time as the propensity to grating was low. When examining the guides used it was however found that those being entirely austenitic from the start showed a converted zone in the area showing the heaviest wear. That which above all limits the length of life with this steel is the substantial subboundary cracks, FIG. 1.

The next step in the material development was a modified composition of type P2, called P21. In this steel the manganese content was increased to make the austenite of the material more resistive in a cheap way. Furthermore, the molybdenum content has been slightly increased to achieve a greater secondary hardening in tempering. From this alloy, too, fifteen roller entry guides were made which were, with success, tested in operation. The strength and resistance to wear were just as good as with steels of the P2 type. A positive factor is also that the tubes are very little subjected to grating. This may be owing to the lubricating quality of the manganese oxide at high temperatures.

Desired is that the alloying cost of the products should be kept at as low a level as possible. So a series of different steel types with very high manganese content were produced, types C, D, E and Z, and a desire was also to get a stable austenitic material with retained carbide lattice. As to steel No. 8, type C, it had already in its cast state too high a hardness, due to the fact that it is nitrogen-alloyed. In consequence of this it is sensitive to thermal-shock cracking. Steel No. 9, type E, proved in spite of its high manganese content not to have a stable austenitic phase. Thus a roughly 20% magnetic phase was obtained in the material after annealing at 1000° C. From type D, steel No. 10, and from type Z, steel No. 11, a couple of roller entry guides were made which were tested in a tube mill. After 300 pierced tube blanks the Z guide was heavily worn. The D guide on the other hand showed very slight wear. Unfortunately it was so badly damaged by lattice cracking that it broke in the dismounting. These two alloys showed very inconsiderable grating on the tube blanks which is probably attributable to the high manganese content.

Finally a number of charges were produced of type P3 from which roller entry guides were manufactured and tested in the piercing of tube blanks. It appeared that steels of this type showed just as high resistance to wear as type D and just as small a propensity of grating as types D and Z. At the same time the strength was good or very good (no guide was disabled in the tests) in the experiments using roller entry guides for piercing tube blanks. The experiences gained are summarized in Table 3. In the comparison the following criteria were applied.

TABLE 3

| | | | | |
|---|---|---|---|---|
| Resistance to hot cracks | Very good 4 | Good 3 | Small 2 | Very small 1 |
| Resistance to wear | Very good 4 | Good 3 | Small 2 | Very small 1 |

TABLE 3-continued

| Propensity to grating | Very small 4 | Small 3 | Large 2 | Very large 1 |
|---|---|---|---|---|
| Steel type | Resistance to hot cracks | Resistance to wear | | Propensity to grating |
| L | 2 | 3 | | 3 |
| P | 1 | (not evaluated) | | |
| P21 | 3 | 3 | | 3 |
| D | 2 | 4 | | 4 |
| Z | 4 | 1 | | 4 |
| P3 | 3 | 4 | | 4 |

The best combination of properties is possessed by type P3 which is contained in the alloy combination according to this invention. The tests performed show that the properties sought for can be obtained with steel having compositions as per Table 4. The percentages are by weight.

TABLE 4

| % by Weight | Primary Range | Preferred Range | Suitable Range | Preferred Composition |
|---|---|---|---|---|
| C | 0.9—3 | 1–2 | 1.3–1.7 | 1.5 |
| Si | 0.3–2.5 | 0.3–2.5 | 0.3–1.5 | abt 0.7 |
| Mn | 0.5–4 | 1–3 | 1.5–3.0 | 2.0 |
| Cr | 15–25 | 19–24 | 20–23 | 21.5 |
| Ni | 1.5–8 | 3–7 | 4–6 | 5.0 |
| Mo | 0.2–1.8 | 0.3–1.2 | 0.4–0.8 | 0.6 |
| W | 0.5–2.0 | 0.8–1.8 | 1.0–1.8 | 1.25 |
| V | 1.5–4 | 1.7–3 | 2 –2.5 | 2.25 |

The balance is essentially iron and impurities in normal contents.

Figure 5:
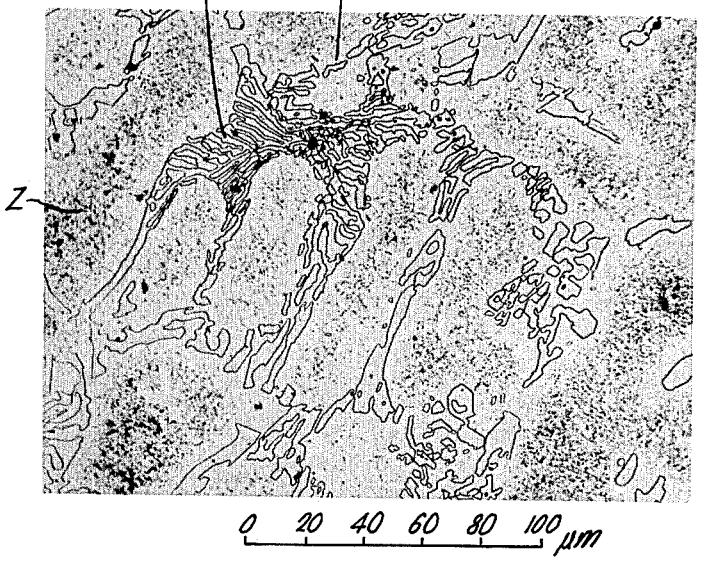
FIG. 5 shows a microphoto of a steel alloy according to the invention, in a cast, unprocessed state.
Figure 6:
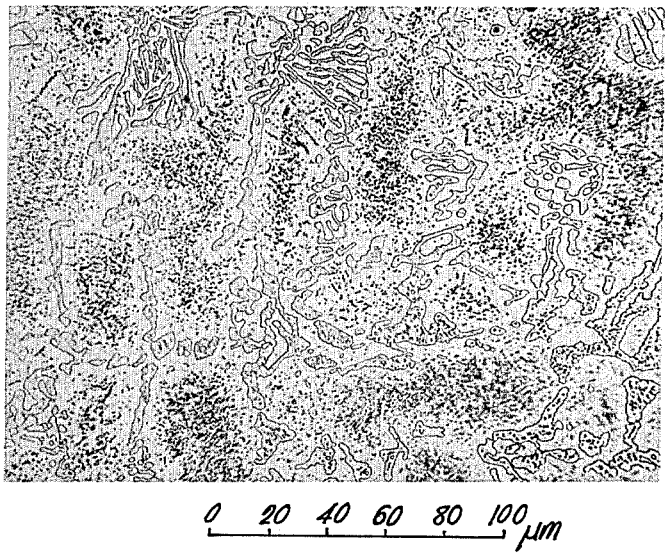
FIG. 6 shows a microphoto of a steel alloy according to the invention in a cast and thereafter annealed state.

The tested steels were also studied as to their structure. FIGS. 5 and 6 show the microstructure of the steel referred to by the present invention in its cast or cast and then solution heat treated condition. The cast structure, FIG. 5, consists of a matrix X, essentially austenite (martensite content <10%). Furthermore the cast structure contains large chrome carbides Y in lattice. The content of chrome carbides more specifically amounted to 15–35% by volume and with the chosen alloy to 20 to 30% by volume. In addition there are in the matrix finely dispersed, small vanadium carbides Z. The hardness was measured as roughly 35 HRC.

FIG. 6 shows the same material which has after casting been solution heat treated at 1160° C. and then left to cool to room temperature in air. From the microphoto you can see that the big aggregates of chrome carbides have partly been broken up. Matrix was entirely austenitic. The vanadium carbides had increased somewhat in size. In this case the hardness was measured as roughly 36 HRC.

A specimen of the steel was after solution heat treatment at 1160° C. and quenching in water also exposed to aging at 750° C. for 3 hours. Then a further precipitation of submicroscopical vanadium carbides was obtained, resulting in a hardness increase to roughly 40 HRC.

For certain applications where the high hardness is decisive the steel can preferably be used in its aged state. With guides, however, no considerable advantage has been shown by post-treatment after casting. For mandrels a solution heat treatment is recommended in order further to minimize the sensitivity to thermal shocks of the material.

The material can also be welded, in doing which the cast structure is broken down. Through this the material can be still more insensitive to thermal shocks which may have a certain importance for such applications as hot-working tools, drop-forging tools, wear plates for anvils, and material for extrusion, i.e. tools exposed to heavy wear at great temperature variations.

We claim:

1. Steel alloy in particular for parts exposed to heavy stresses and wear by objects of high temperatures, consisting essentially of the following chemical composition in percentage by weight:

C—0.9–3
Si—0.3–2.5
Mn—0.5–4
Cr—15–25
Ni—1.5–8
Mo—0.2–1.8
W—0.5–2.0
V—1.5–4

Balance iron and impurities in normal contents.

2. Steel alloy according to claim 1, consisting essentially of the following chemical composition in percentage by weight:

C—1–2
Si—0.3–2.5
Mn—1–3
Cr—19–24
Ni—3–7
Mo—0.3–1.2
W—0.8–1.8
V—1.7–3

Balance iron and impurities in normal contents.

3. Steel alloy according to claim 2, consisting essentially of the following chemical composition in percentage by weight:

C—1.3–1.7
Si—0.3–1.5
Mn—1.5–3.0
Cr—20–23
Ni—4–6
Mo—0.4–0.8
W—1.0–1.8
V—2–2.5

Balance iron and impurities in normal contents.

4. Steel alloy according to claim 3, consisting essentially of the following chemical compostion in percentage by weight:

C—1.5
Si—appro. 0.7
Mn—2.0
Cr—21.5
Ni—5.0
Mo—0.6
W—1.25
V—2.25

Balance iron and impurities in normal contents.

5. Steel alloy according to one of claims 1–4, characterized by a cast structure having an essentially austenitic matrix and a lattice of large, more or less connected chrome carbides corresponding to 15–35, percent by volume of the alloy.

6. Steel alloy according to claim 5, characterized by the fact that it contains finely dispersed vanadium carbides in its austenitic matrix.

7. Steel alloy according to claim 5 characterized by the fact that after solution heat treatment it has an entirely austenitic matrix.

8. Steel alloy according to claim 5, characterized by the fact that after solution heat treatment followed by rapid quenching and aging it has a matrix containing 5–15% martensite, the rest being austenite, in addition to which the matrix contains submicroscopical vanadium carbide precipitations.

9. A tube piercing mill roller entry guide of the alloy of claim 1.

10. A tube mill rolling mandrel of the alloy of claim 1.

11. Steel alloy according to claim 5 characterized by said chrome carbides corresponding to 20–30 percent by volume of the alloy.

* * * * *